US005529092A

United States Patent [19]

Arnoldt

[11] Patent Number: 5,529,092

[45] Date of Patent: Jun. 25, 1996

[54] AIR DUCT TURNING VANE AND RAIL ASSEMBLY

[75] Inventor: Bruce C. Arnoldt, Clairton, Pa.

[73] Assignee: Ductmate Industries, Inc., E. Monongahela, Pa.

[21] Appl. No.: 410,109

[22] Filed: Mar. 24, 1995

[51] Int. Cl.[6] ..... F15D 1/04

[52] U.S. Cl. ..... 138/39; 138/37; 137/561 A

[58] Field of Search ..... 138/39, 37; 137/561 A; 29/513; 428/597

[56] References Cited

U.S. PATENT DOCUMENTS

| | | | |
|---|---|---|---|
| 2,292,246 | 8/1942 | Steffens | 138/39 |
| 2,396,816 | 3/1946 | Callan | 138/75 |
| 2,826,221 | 3/1958 | Speiser | 138/39 |
| 2,861,597 | 11/1958 | Gracer | 138/39 |
| 2,884,956 | 5/1959 | Perlin | 138/39 |
| 2,959,195 | 11/1960 | Gracer | 138/39 |
| 2,972,358 | 2/1961 | Hinden | 138/39 |
| 3,050,160 | 8/1962 | Chesser | 189/36 |
| 3,075,450 | 1/1963 | Noll | 98/46 |
| 3,105,520 | 10/1963 | Lorett et al. | 138/39 |
| 3,144,204 | 8/1964 | Bohanon | 230/134 |
| 3,224,668 | 12/1965 | Olmsted et al. | 230/134 |
| 3,310,287 | 3/1967 | Clark et al. | 253/78 |
| 3,381,713 | 5/1968 | Jacobsen | 138/39 |
| 3,405,737 | 10/1968 | Harper | 138/39 |
| 3,494,379 | 2/1970 | Hinden | 138/39 |
| 3,602,262 | 8/1971 | Hinden | 138/39 |
| 4,019,537 | 4/1977 | Bonnard et al. | 138/37 |
| 4,467,829 | 8/1984 | Myers | 137/561 |
| 4,586,540 | 5/1986 | DeLord | 139/39 |
| 4,641,684 | 2/1987 | DeLord | 137/561 |
| 4,911,205 | 3/1990 | Myers | 138/39 |
| 4,995,426 | 2/1991 | Hinden | 138/39 |
| 5,068,957 | 12/1991 | Felson | 29/566 |
| 5,181,314 | 1/1993 | Lyons et al. | 29/796 |
| 5,405,106 | 4/1995 | Chintamani et al. | 138/39 X |

FOREIGN PATENT DOCUMENTS

| | | |
|---|---|---|
| 944405 | 3/1974 | Canada . |
| 1557612 | 12/1979 | United Kingdom . |

OTHER PUBLICATIONS

Tuttle & Bailey, Catalog No. 41, p. 50.
Sheet Metal Worker, Oct. 1953, pp. 28, 85.

*Primary Examiner*—Stephen F. Gerrity
*Assistant Examiner*—Patrick F. Brinson
*Attorney, Agent, or Firm*—Buchanan Ingersoll; George Raynovich, Jr.

[57] ABSTRACT

An air turning vane and rail assembly for use in heating, ventilating and air conditioning ducts is provided. The rail is formed with tabs that are partially punched from the sheet metal rail and bent to a position perpendicular to the rail. The tabs are further bent to generally approximate the arcuate shape of the vanes to be received by the rail. The tabs extend the full width of the vanes that are positioned on them. Either single walled or double walled turning vanes are positioned on the tabs and the tabs and the vanes are crimped together to retain the vanes on the tabs. Because the tabs extend the full width of the vanes, the vanes are automatically positioned so that they are parallel to each other and so that their vertical center lines are aligned with each other.

19 Claims, 3 Drawing Sheets

AIR DUCT TURNING VANE AND RAIL ASSEMBLY

BACKGROUND OF THE INVENTION

1. Field of the Invention

This invention is directed to air turning vane and rail assemblies utilized in ventilation and air conditioning ducts that are found in commercial, industrial and residential buildings. The turning vane and rail assemblies are positioned within the ducts where the ducts change direction in order to promote laminar flow of the air within the duct during the directional change of the air as it flows through the duct.

The ventilation and air conditioning ductwork used in buildings is typically formed of straight rectangular cross section tubes which may change direction as much as 90° through the use of transition sections or simply by forming the sheet metal ducts in such a manner as to make the turn. If the air flowing through the ductwork becomes turbulent because of the change of direction, there can be a large pressure loss and undesirable vibration and noise.

2. Description of the Prior Art

Various types of turning vanes have been patented since as early as the 1930s. While the general purpose of the turning vanes has not changed, the various configurations of the turning vanes have been changed through the years to facilitate the assembly of the turning vanes within the ductwork. Some examples of various configurations of turning vanes and their supporting structures are shown in the following U.S. patents:

| | |
|---|---|
| 2,826,221 | 3,494,379 |
| 2,861,597 | 3,602,262 |
| 2,959,195 | 4,467,829 |
| 3,105,520 | 4,586,540 |
| 3,310,287 | 4,641,684 |
| 3,381,713 | 4,911,205 |
| 3,405,737 | 4,995,426 |

Even though many configurations of turning vanes and support systems have been devised, there is still a requirement for providing an efficient turning vane and rail assembly which may be rapidly assembled and positioned within an air duct.

Accordingly, an object of the present invention is to provide an air duct turning vane and rail assembly which permits ready assembly of the vanes on the rail.

Another object of the present invention is to provide a rail that is stackable so that the rails may be readily transported to the job site.

Another object of the present invention is to provide an air duct turning vane and rail assembly in which tabs partially punched from the rail support the turning vanes throughout the entire width of the turning vanes so that the vanes are properly positioned relative to each other and to the rails.

These and other objects of the present invention will becomes apparent as this description proceeds in conjunction with the following specification and appended claims.

DESCRIPTION OF THE PREFERRED EMBODIMENTS

Figure 1:
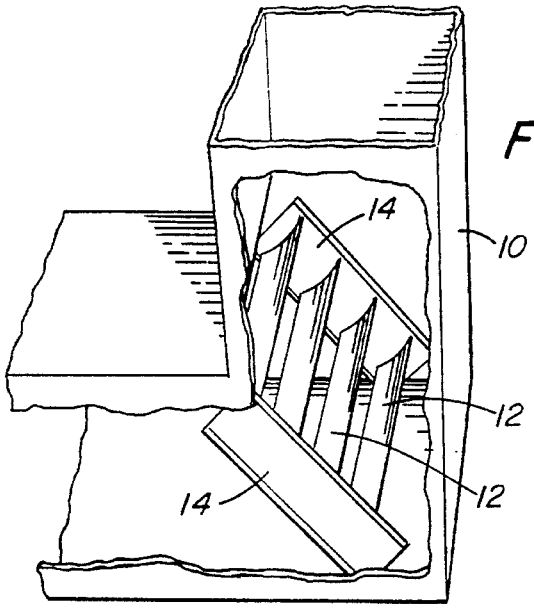
FIG. 1 is a perspective view of the air turning vane and rail assembly of the present invention installed within an air duct with a portion of the air duct broken away.
Figure 2:
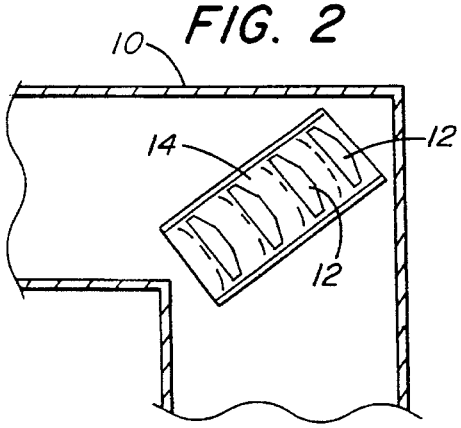
FIG. 2 is a plan view of the air turning vane and rail assembly within a duct.

Referring to the drawings and particularly to FIGS. 1 and 2, there is shown an air duct 10 which turns at 90°. Turning vanes 12 are positioned within the air duct 10 and are supported by rails 14 that are attached to the duct walls. In conventional fashion, the turning vanes facilitate the change of direction of air flowing through the duct 10 at the corner where the duct changes direction.

Figure 4:
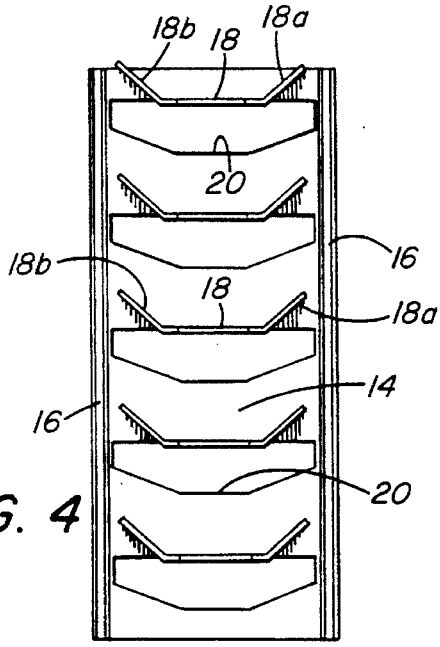
FIG. 4 is a top plan view of the rail of FIG. 3.
Figure 3:
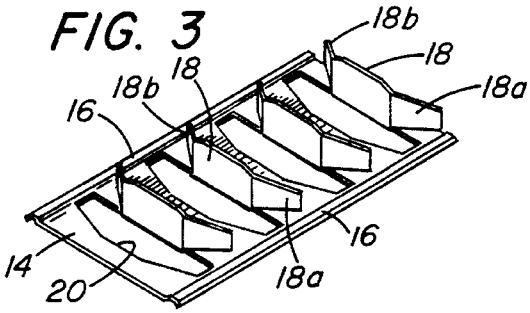
FIG. 3 is a perspective view of the rail which supports the turning vanes of the present invention.
Figure 5:
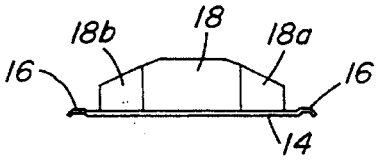
FIG. 5 is an end view of the rail of FIG. 4.
Figure 6:
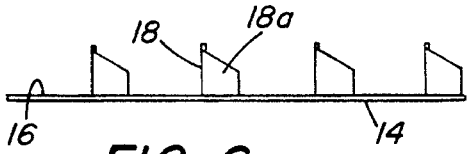
FIG. 6 is a side view of the rail of FIG. 4.

Referring to FIGS. 3 through 6, details of the rail of the present invention are shown. As seen in FIG. 3, the rail 14, which is preferably formed from sheet metal, has ridges 16 formed on each edge to strengthen the rail. Tabs 18 are partially punched from the rail 14 leaving holes 20 when the tabs 18 are bent perpendicular to rail 14 as best seen in FIGS. 4 and 6. The tabs 18, after being partially punched, are bent vertically to rails 14 and wings **18*a* and 18*b* are bent out of the plane of the main body of tab 18 so that the tabs 18 with the wings 18*a* and 18*b* generally approximate the curvature of turning vanes 12**.

It will be seen that because of the holes 20 which are left when the tabs 18 are bent to their vertical positions and the wings **18*a* and 18*b* are bent away from the main body of tab 18, the rails 14 are stackable one over the other by having the tabs 18 protrude through the holes 20 of adjacent rails. This stackable feature permits more efficient transportation of the rails 14** to the job site.

Figure 7:
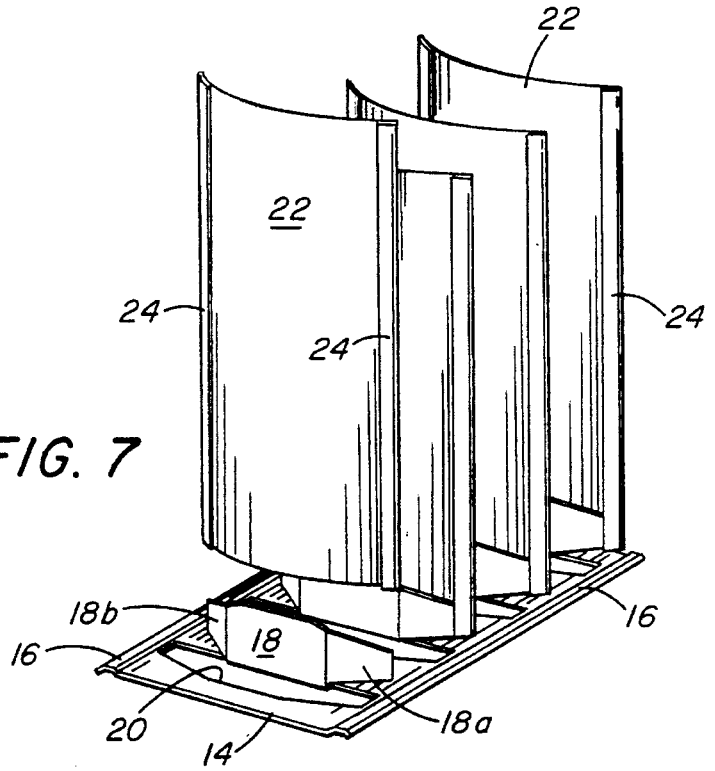
FIG. 7 is a perspective view of a partially assembled air duct turning vane and rail assembly with vanes formed from a single piece of sheet metal.
Figure 8:
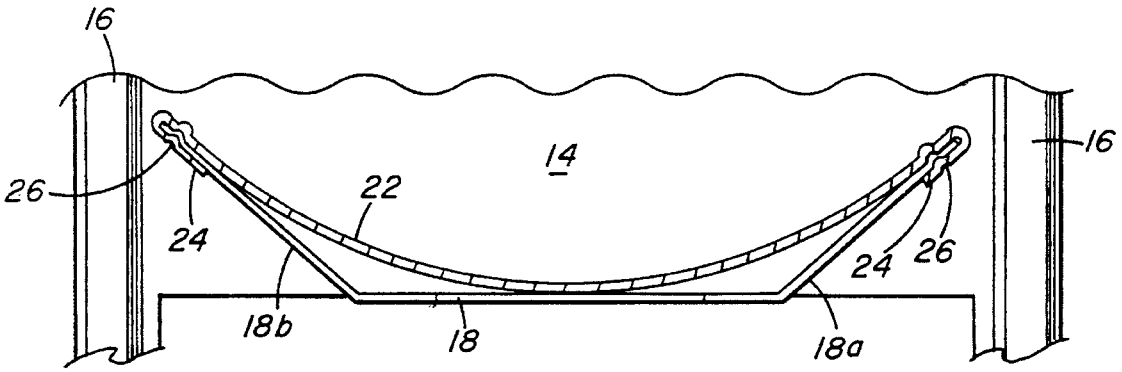
FIG. 8 is a top plan view of one of the vanes and securing tab of the assembly of FIG. 7.

Referring now to FIGS. 7 and 8, further details of the air turning vane and rail assembly of the present invention with a turning vane formed from a single piece of sheet metal are shown. As viewed in FIGS. 7 and 8, the single sheet vane 22 is formed by bending the sheet metal in an arcuate shape about the vertical center line of the vane. Each vertical edge of the vane has a hem 24 formed upon it by turning the edge back toward the single sheet vane 22.

The rail shown in FIGS. 7 and 8 has previously been described in detail in connection with the description of FIGS. 3–6. To assemble the turning vane and rail assembly of FIGS. 7 and 8, the single sheet vane 22 is positioned over the tab 18 and the wings **18*a* and 18*b* of tab 18 are captured within the hems 24 at each side of the vane 22. After the vane 22 is positioned against the rail 14 in its lowermost position as viewed in FIG. 7, the hems 24 and the wings 18*a* and 18*b* of tab 18 are crimped together as shown at 26 by use of a standard sheet metal crimping tool that is in common use with heating, ventilating and air conditioning (HVAC) contractors. It should be noted that the hems 24 on vane 22** reduce the chances of workmen cutting themselves on the single walled vane.

Figure 9:
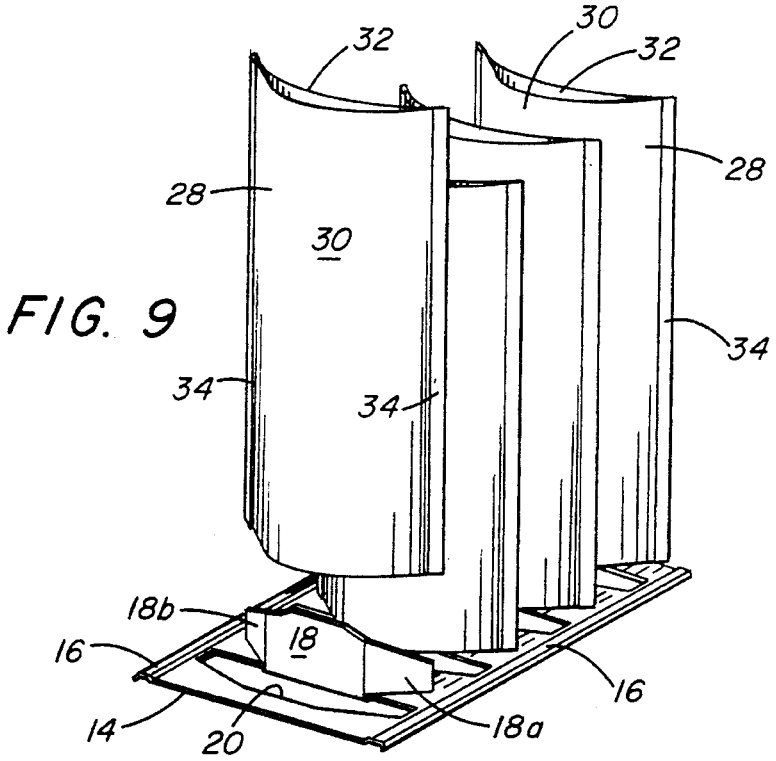
FIG. 9 is a perspective view of a partially assembled turning vane and rail assembly of the present invention similar to FIG. 7 showing a double wall turning vane.
Figure 10:
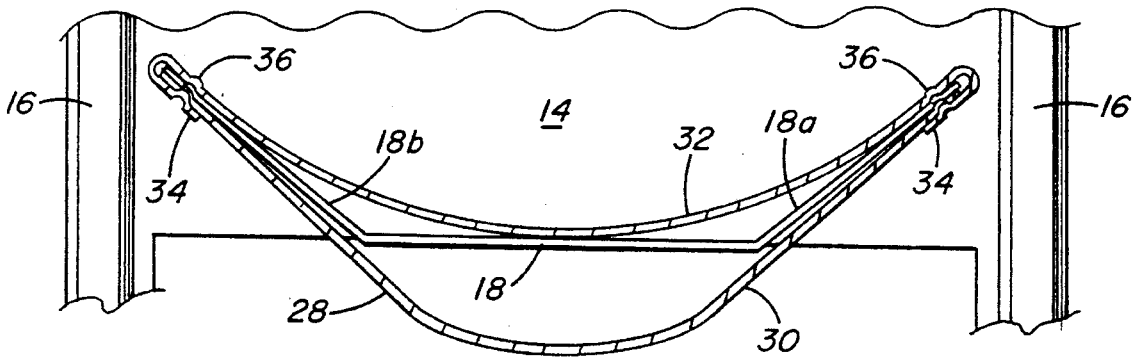
FIG. 10 is a top plan view of one of the vane securing tabs of the assembly of FIG. 9.

Referring now to FIGS. 9 and 10 there is shown in greater detail the turning vane and rail assembly of the present invention utilized with a double wall turning vane 28. As best seen in FIG. 10, the double wall turning vane 28 has a wall 30 and wall 32 which are joined together at their edges by a seam 34 formed on wall 32. The wall 30 is bent around its vertical center line to form an arcuate shape having a first radius of curvature and the wall 32 is bent around its vertical center line with a radius of curvature different then the radius of curvature of wall 30 so that when the edges of the two walls 30 and 32 are joined together, there is a hollow space between them providing the double walled vane 28. Double walled vanes are in common use in the HVAC industry. The walls 30 and 32 of the double walled vane 28 are each preferably formed of sheet metal.

Referring now to FIG. 9, it will be seen that the double wall vane is positioned on a rail 14 which has previously been described in detail in the description of FIGS. 3–6. The double wall vane 28 is placed over the tab 18 so that the wings 18*a* and 18*b* of tab 18 extend out to the edges of walls 30 and 32. After the double walled vane is positioned down over the tab 18 until it abuts rail 14, the walls 32 and 34 and the respective wings 18*a* and 18*b* are crimped together as shown at 36 to fasten the vane to the tabs.

It will be seen that in both embodiments of this invention, the tabs 18 with the wings 18*a* and 18*b* extend across the full width of the respective vanes 22 (FIGS. 7 and 8) and 28 (FIGS. 9 and 10). By extending all the way across the respective vanes, the tabs 18 position the vanes in only one position with respect to the rails 14. Thus, the vanes are parallel to each other after assembly and the center lines of the vanes are aligned with each other as required for smooth flow of air over the vanes.

As seen in FIG. 1, it is customary to position a rail 14 at each end of the vanes to support the vanes properly. This description has shown in detail how the vanes are assembled on one rail 14. It will be appreciated that a second rail can be positioned at the other ends of the vanes by placing the tabs of the rail in an appropriate position relative to the vanes and crimping the vanes and the tabs together so that a turning vane and rail assembly having a rail at each end of the vanes will be produced.

According to the provisions of the patents statues, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. An air turning vane and rail assembly for promoting laminar air flow in angled ductwork sections comprising:

an elongated base rail;

a plurality of tabs each partially punched from said base rail and bent into a position perpendicular to said base rail with a main body of each of said tabs being attached to said base rail and wings at either end of said main body being attached to said tab main body and free of said base rail;

a plurality of turning vanes each being formed in an arcuately curved shape about the vertical centerline of said vane;

said plurality of turning vanes being positioned on said tabs so that said turning vanes are supported on said base rail and the vertical centerlines of said vanes are perpendicular to said base rail; said plurality of tabs each being of a size to extend the full width of each of said plurality of turning vanes so that said tabs contact said turning vanes at the vertical edges of said vanes and retain said turning vanes on said tabs at the vertical edges of said vanes.

2. The air turning vane and rail assembly of claim 1 wherein said plurality of turning vanes are each formed from a single piece of sheet metal with the vertical edges of said turning vanes parallel to said vertical centerline being hemmed by folding said sheet metal back upon itself to receive said tabs.

3. The air turning vane and rail assembly of claim 1 wherein said plurality of turning vanes are each formed from two pieces of sheet metal with a first piece of sheet metal being arcuately curved about the vertical centerline of said first piece of sheet metal and having a first radius of curvature and a second piece of sheet metal being arcuately curved about the vertical centerline of said second piece of sheet metal and having a different radius of curvature from said first radius of curvature, said two pieces of sheet metal being joined together at their vertical edges whereby said two pieces of sheet metal form the double walls of a double wall vane with said tabs being positioned between said double walls.

4. The air turning vane and rail assembly of claim 2 wherein said tabs are captured between said sheet metal vanes and the hemmed edge portions of said sheet metal vanes to secure said vanes to said rail.

5. A rail unit for securing a plurality of air turning vanes within angled ductwork sections comprising:

an elongated base formed from sheet metal;

a plurality of tabs each partially punched from said base rail and bent into a position perpendicular to said base rail with a main body of each of said tabs being attached to said base rail and wings at either end of said main body being attached to said tab main body and free of said base rail;

said tabs being arranged to position said turning vanes parallel to each other when said turning vanes are secured to said rail;

said tabs being of a size to extend the full width of said turning vanes that are secured to said rail so that the outer edges of said turning vanes are secured by said tabs.

6. The rail unit of claim 5 wherein each of said tabs is formed in more than one plane after said tabs are partially punched from said base and bent into position.

7. The rail unit of claim 6 wherein each of said tabs extends the full width of the vane supported by it whereby the center lines of said vanes are aligned with each other.

8. The rail unit of claim 5 wherein a plurality of said rail units are nestable to provide for efficient shipping of said rail units.

9. An air turning vane and rail assembly for promoting laminar air flow in angled ductwork sections comprising:

an elongated base rail formed from sheet metal;

a plurality of tabs each partially punched from said base rail and bent into a position perpendicular to said base rail with a main body of each of said tabs being attached to said base rail and wings at either end of said main body being attached to said tab main body and free of said base rail;

a plurality of turning vanes each being formed in an arcuately curved shape about the vertical centerline of said vane;

said plurality of turning vanes each being positioned on one of said tabs so that said turning vanes are supported on said base rail and the vertical centerlines of said vanes are perpendicular to said base rail with said angled end portions of said tabs and said main body of said tabs generally approximating the arcuately curved shape of said turning vanes and extending the full width of said turning vanes to retain said turning vanes on said tabs at the vertical edges of said vanes.

10. The air turning vane and rail assembly of claim 9 wherein said plurality of turning vanes are each formed from a single piece of sheet metal with the edges of said turning vanes parallel to said vertical centerline being hemmed by folding said sheet metal back upon itself to receive said tabs.

11. The air turning vane and rail assembly of claim 9 wherein said plurality of turning vanes are each formed from two pieces of sheet metal with a first piece of sheet metal being arcuately curved about the vertical centerline of said first piece of sheet metal and having a first radius of curvature and a second piece of sheet metal being arcuately curved about the vertical centerline of said second piece of sheet metal and having a different radius of curvature from said first radius of curvature, said two pieces of sheet metal being joined together at their vertical edges whereby said two pieces of sheet metal form the double walls of a double wall vane with said tabs being positioned between said double walls.

12. The air turning vane and rail assembly of claim 10 wherein said tabs are captured between said sheet metal vanes and the hemmed edge portions of said sheet metal vanes to secure said vanes to said rail.

13. The air turning vane and rail assembly of claim 11 wherein said tabs are captured between said first and second pieces of sheet metal to secure said vanes to said rail.

14. The air turning vane and rail assembly of claim 9 wherein each of said tabs extends the full width of the vane supported by it whereby the center lines of said vanes are aligned with each other.

15. The air turning vane and rail assembly of claim 9 wherein said elongated base rail is fixed within an angled ductwork section.

16. The air turning vane and rail assembly of claim 9 wherein a second elongated base rail identical to said elongated base rail is positioned in parallel spaced relation with said elongated base rail with the tabs of said second elongated base rail supporting the opposite ends of each of said vanes from the ends of each of said vanes supported by said elongated base rail.

17. The air turning vane and rail assembly of claim 12 wherein said tabs are captured between said sheet metal vanes and said hemmed edge portions of said sheet metal vanes by crimping said tabs and said vanes together.

18. The air turning vane and rail assembly of claim 13 wherein said tabs are captured between said first and second pieces of sheet metal by crimping said tabs and the edges of said first and second pieces of sheet metal together.

19. The air turning vane and rail assembly of claim 11 wherein said tabs are captured between said first and second pieces of sheet metal to secure said vanes to said rail.

* * * * *